US008891994B2

(12) United States Patent
Tabata

(10) Patent No.: US 8,891,994 B2
(45) Date of Patent: Nov. 18, 2014

(54) IMAGE FORMING APPARATUS FORMING TONER PATCH IMAGE ON IMAGE CARRIER

(71) Applicant: Konica Minolta, Inc., Tokyo (JP)

(72) Inventor: Eiji Tabata, Ibaraki (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/923,014

(22) Filed: Jun. 20, 2013

(65) Prior Publication Data

US 2014/0037315 A1 Feb. 6, 2014

(30) Foreign Application Priority Data

Jun. 21, 2012 (JP) ..... 2012-139788

(51) Int. Cl.
*G03G 15/00* (2006.01)
*G03G 15/16* (2006.01)
*G03G 21/00* (2006.01)

(52) U.S. Cl.
CPC ..... *G03G 21/0005* (2013.01); *G03G 15/5058* (2013.01); *G03G 15/168* (2013.01); *G03G 2215/1661* (2013.01)
USPC ..... 399/71; 399/72

(58) Field of Classification Search
USPC ..... 399/71
See application file for complete search history.

(56) References Cited

U.S. PATENT DOCUMENTS

| | | | | |
|---|---|---|---|---|
| 2007/0059027 | A1* | 3/2007 | Ishikawa et al. | 399/101 |
| 2012/0076524 | A1 | 3/2012 | Furukawa | |
| 2012/0099883 | A1 | 4/2012 | Kikuchi et al. | |

FOREIGN PATENT DOCUMENTS

| | | | |
|---|---|---|---|
| JP | 59083185 | A | 5/1984 |
| JP | 06118854 | A | 4/1994 |
| JP | 10333514 | A | 12/1998 |
| JP | 2006-267283 | | 10/2006 |
| JP | 2007-25173 | | 2/2007 |
| JP | 2007-72398 | | 3/2007 |
| JP | 2010091600 | A | 4/2010 |
| JP | 2012073320 | A | 4/2012 |
| JP | 2012088671 | A | 5/2012 |

OTHER PUBLICATIONS

Japanese Office Action dated Aug. 19, 2014 in counterpart Japanese Application No. 2012-139788.

* cited by examiner

*Primary Examiner* — Clayton E Laballe
*Assistant Examiner* — Jas Sanghera
(74) *Attorney, Agent, or Firm* — Holtz Holtz Goodman & Chick, PC

(57) ABSTRACT

An image forming apparatus includes a secondary transfer belt that rotates, an imaging unit for forming a patch image of toner on the secondary transfer belt, and an upstream brush and a downstream brush coming into contact with the secondary transfer belt in a rotating state to remove the patch image from on the secondary transfer belt. A length p of the patch image formed by the imaging unit along a rotational direction of the secondary transfer belt, a distance b1 over which the secondary transfer belt rotates while the upstream brush makes one turn, and a distance b2 over which the secondary transfer belt rotates while the downstream brush makes one turn satisfy an expression: $p \leq |b1-b2|$.

9 Claims, 17 Drawing Sheets

FIG.12

| CONDITIONS | COMBINATION OF TONER | COMBINATION OF PATHS | CONDITION FOR WHICH TONER DO NOT OVERLAP |
|---|---|---|---|
| 1st CONDITION | TR2 AND TR3 | R2 AND R3 | $p \leqq \lvert b1-b2 \rvert$ |
| 2nd CONDITION | TR2 AND TR4 | R2 AND R4 | $p \leqq b1$ |
| 3rd CONDITION | TR2 AND TR5 | R2 AND R5 | $p \leqq b2$ |
| 4th CONDITION | TR3 AND TR5 | R3 AND R5 | $p \leqq b1$ |
| 5th CONDITION | TR4 AND TR5 | R4 AND R5 | $p \leqq \lvert b1-b2 \rvert$ |
| 6th CONDITION | TR5 AND TR6 | R5 AND R6 | $p \leqq \lvert b1-b2 \rvert$ |

FIG.16

| MODE | LENGTH OF PATCH p(mm) | DISTANCE b1(mm) | DISTANCE b2(mm) | MOVING SPEED Vb1(mm/sec) | MOVING SPEED Vb2(mm/sec) |
|---|---|---|---|---|---|
| 1 | 35 | 50 | 101 | 300 | 150 |
| 2 | 25 | 34 | 67 | 450 | 225 |
| 3 | 50 | 34 | 101 | 450 | 150 |

FIG.17

| | SET CONDITIONS | SET VALUE | | | | | | | | RESULT | |
|---|---|---|---|---|---|---|---|---|---|---|---|
| | | LENGTH p OF PATCH | BRUSH ROLLER CB1 (UPSTREAM) | | | BRUSH ROLLER CB2 (DOWNSTREAM) | | | \|b1−b2\| (Δb) | VISUAL EVALUATION | MAXIMUM ΔE ON BELT |
| | | | d1 | θ1 | b1 | d2 | θ2 | b2 | | | |
| | | mm | mm | − | mm | mm | − | mm | mm | | |
| EXAMPLE 1 | p<\|b1−b2\| | 70 | 18 | 1 | 57 | 18 | 0.4 | 141 | 85 | B | 0.8 |
| COMPARATIVE EXAMPLE 1 | p>b1=b2 | 70 | 18 | 1 | 57 | 18 | 1 | 57 | 0 | C | 3 |
| EXAMPLE 2 | p<\|b1−b2\|、p<b1 | 50 | 18 | 1 | 57 | 18 | 0.5 | 113 | 57 | A | 0.5 |
| EXAMPLE 3 | p<\|b1−b2\|、p<(b1)/2、b1 IS NOT AN INTEGER MULTIPLE OF b2 | 25 | 18 | 1 | 57 | 18 | 0.4 | 141 | 85 | A | 0.5 |
| EXAMPLE 4 | p<\|b1−b2\| | 70 | 36 | 1 | 113 | 12 | 1 | 38 | 75 | B | 0.7 |

A: AT A LEVEL THAT WAS HARDLY RECOGNIZED AS NOISE EVEN WITH A CLOSE LOOK

B: AT A PERMISSIBLE LEVEL ALTHOUGH IT WAS RECOGNIZABLE AS IMAGE NOISE WITH A CLOSE LOOK

C: AT A NON-PERMISSIBLE LEVEL THAT WAS RECOGNIZABLE EVEN WITHOUT A CLOSE LOOK

IMAGE FORMING APPARATUS FORMING TONER PATCH IMAGE ON IMAGE CARRIER

This application is based on Japanese Patent Application No. 2012-139788 filed with the Japan Patent Office on Jun. 21, 2012, the entire content of which is hereby incorporated by reference.

BACKGROUND OF THE INVENTION

1. Field of the Invention

The present invention relates to an image forming apparatus, and more particularly to an image forming apparatus having a patch image forming unit for forming a patch image of toner on an image carrier.

2. Description of the Related Art

Image forming apparatuses using electrophographic techniques include, for example, MFPs (Multi-Functional Peripherals) with a scanner function, a facsimile function, a copy function, a printer function, a data communication function, and a server function, facsimile machines, copiers, and printers.

Image forming apparatuses generally form an image on paper by forming a toner image by developing a electrostatic latent image formed on an image carrier, transferring the toner image onto paper, and fixing the toner image on paper with a fixing unit. Some image forming apparatuses form a toner image by developing an electrostatic latent image formed on a photoconductor drum, transfer the toner image onto an intermediate transfer belt using a primary transfer roller, and secondary-transfer the toner image on the intermediate transfer belt onto paper using a secondary transfer belt. In this case, the photoconductor drum, the intermediate transfer belt, and the secondary transfer belt each are an image carrier. The image carrier is equipped with a cleaning device for removing toner residue from the image carrier after a toner image is transferred.

Image forming apparatuses form a patch image on an image carrier at a predetermined timing for the purpose of registration of a toner image, density control, or forced consumption of toner. The patch image is formed in a non-image region existing between two image regions (regions where toner images to be transferred onto paper are formed) on the image carrier. Image forming apparatuses remove patch toner, which is toner of a patch image, on the photoconductor drum using a photoconductor drum cleaning device, remove patch toner on the intermediate transfer belt using an intermediate transfer belt cleaning device, or remove patch toner on the secondary transfer belt using a secondary transfer belt cleaning device. Image forming apparatuses may transfer part of a patch image from the intermediate transfer belt onto the secondary transfer belt and remove patch toner on the secondary transfer belt and patch toner left on the intermediate transfer belt using the respective cleaning devices.

The amount of adhering patch toner per unit area is as large as 3 $g/m^2$ to 10 $g/m^2$, for example. No matter which of the cleaning devices is used, the cleaning device thus has to remove the large amount of toner when removing the patch toner. The toner left on the image carrier that fails to be removed by the cleaning device may adhere to paper to cause image noise.

There is proposed a cleaning device that performs cleaning on an image carrier by applying bias and bringing a conductive brush (conductive brush roller) driven to rotate into contact with the image carrier. This method is advantageous when a large amount of toner such as patch toner is removed because a conductive brush having a large surface area is used to recover toner on the image carrier by both a mechanical effect and an electrostatic effect.

A cleaning device using a conductive brush is known which recovers toner on the conductive brush by applying bias and bringing a recovering roller driven to rotate into contact with the conductive brush. In this cleaning device, toner on the image carrier is first recovered onto the conductive brush, then carried to a contact portion between the conductive brush and the recovering roller by rotation of the conductive brush, and recovered to the recovering roller at this contact portion because of a potential difference between the recovering roller and the conductive brush. The toner is thereafter carried to a contact portion between the recovering roller and a scraper by rotation of the recovering roller, and scraped off by the scraper at the contact portion.

In order to recover a large amount of toner from on the image carrier onto the conductive brush, the conductive brush has to receive an appropriate voltage while rotating with a sufficient peripheral speed ratio relative to the peripheral speed of the image carrier. Toner on the image carrier, however, partially slips through the conductive brush and, as a result, is left on the image carrier without being recovered by the conductive brush (such toner is hereinafter also called slipping toner). The slipping toner adheres to paper at the secondary transfer unit, causing image noise.

Part of toner recovered by the conductive brush is not completely recovered by the recovering roller at the contact portion and is left on the conductive brush. The toner left on the conductive brush may be carried by rotation of the conductive brush again to the contact portion with the image carrier and discharged onto the image carrier (such toner is hereinafter also called discharged toner). The discharged toner also causes image noise.

Some cleaning apparatuses using conductive brushes have two or more conductive brushes arranged along the rotational direction of the image carrier for the purpose of improving cleaning performance. Such cleaning apparatuses are advantageous in particular when a large amount of toner is to be removed because toner that is not completely removed by an upstream conductive brush is removed by a downstream conductive brush. Toner passing through the primary transfer unit, the secondary transfer unit, and the contact portion between the cleaning device and the image carrier has a broad charge distribution of opposite polarities. In order to electrostatically remove such toner, voltages of different polarities should be applied to the upstream conductive brush and the downstream conductive brush. For example, voltage of positive polarity is applied to the upstream conductive brush to recover negatively charged toner, and voltage of negative polarity is applied to the downstream conductive brush to recover positively charged toner.

For example, Documents 1 and 2 below disclose cleaning devices. Document 1 below discloses a configuration in which there is a difference between the peripheral speed of an upstream conductive brush and the peripheral speed of a downstream conductive brush. Document 2 below discloses a configuration in which there is a difference between the outer diameter of an upstream conductive brush and the outer diameter of a downstream conductive brush.

Document 1: Japanese Laid-Open Patent Publication No. 2006-267283

Document 2: Japanese Laid-Open Patent Publication No. 2007-25173

If poor cleaning toner such as slipping toner or discharged toner adheres at a certain level or more to a portion of paper, it is visually recognized as image noise at that portion. Conventionally, those portions where poor cleaning toner adheres are present disproportionately. Therefore, even when the cleaning performance of the cleaning device is high and the total amount of adherence of poor cleaning toner is relatively small, the poor cleaning toner is visually recognized as image noise at the portion where the amount of adherence is large.

SUMMARY OF THE INVENTION

An object of the present invention is to provide an image forming apparatus capable of suppressing image noise.

An image forming apparatus according to an aspect of the present invention includes: an image carrier that rotates; a patch image forming unit for forming a patch image of toner on the image carrier; a first rotator coming into contact with the image carrier in a rotating state to remove the patch image from on the image carrier; and a second rotator arranged downstream from the first rotator along a rotational direction of the image carrier and coming into contact with the image carrier in a rotating state to remove the patch image from on the image carrier. A length p of the patch image formed by the patch image forming unit along the rotational direction of the image carrier, a distance b1 over which the image carrier rotates while the first rotator makes one turn, and a distance b2 over which the image carrier rotates while the second rotator makes one turn satisfy the following expression (1): $p \leq |b1-b2|$.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 12 is a table showing relational expressions where poor cleaning toner satisfies the first to sixth conditions.

FIG. 16 is a diagram schematically showing an adjustment table for use in a second modification of the present invention.

FIG. 17 is a table showing set conditions, specific set values, and evaluation results in Example 1 to 4 of the present invention and Comparative Example 1.

DESCRIPTION OF THE PREFERRED EMBODIMENTS

An embodiment of the present invention will be described below based on the figures.

In the description of the present embodiment, the image forming apparatus is an MFP. The image forming apparatus may be any other apparatus such as a facsimile device, a copier, or a printer. In particular, the preferred image forming apparatus is the one that transfers an image on an image carrier onto an intermediate transfer body and electrostatically transfers the image on the intermediate transfer body onto a recording material.

[Configuration of Image Forming Apparatus]

Figure 1:
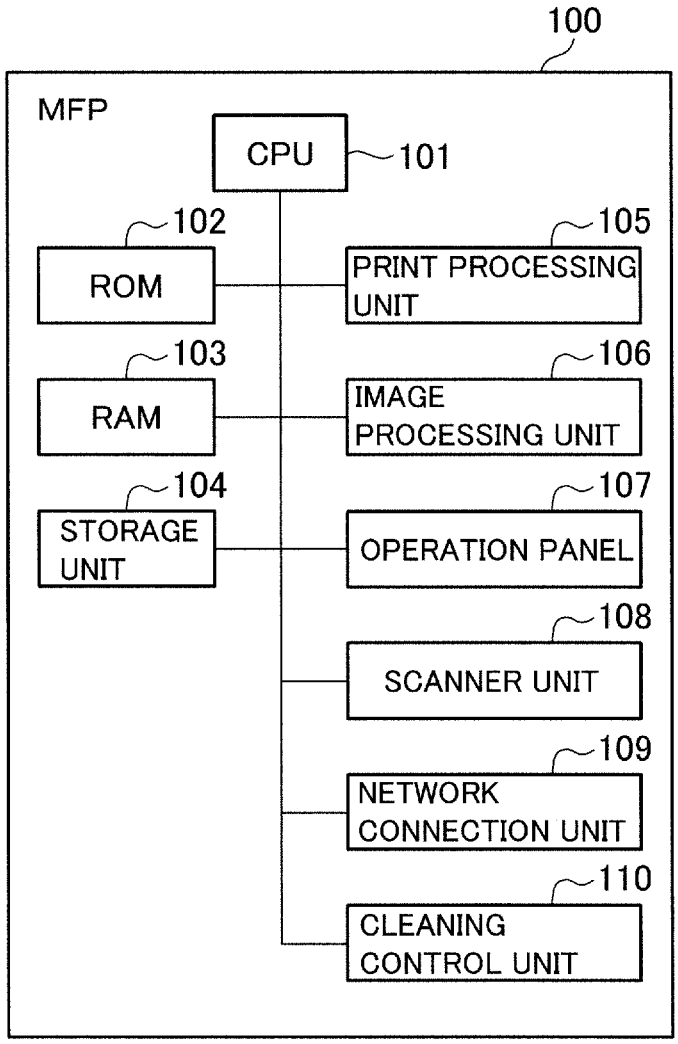
FIG. 1 is a block diagram showing an internal configuration of an MFP 100 according to an embodiment of the present invention.

Referring to FIG. 1, an MFP 100 (an example of the image forming apparatus) mainly includes a CPU (Central Processing Unit) 101, a ROM (Read Only Memory) 102, a RAM (Random Access Memory) 103, a storage unit 104, a print processing unit 105, an image processing unit 106, an operation panel 107, a scanner unit 108, a network connection unit 109, and a cleaning control unit 110. ROM 102, RAM 103, storage unit 104, print processing unit 105, image processing unit 106, operation panel 107, scanner unit 108, network connection unit 109, and cleaning control unit 110 are each connected to CPU 101 through a bus.

CPU 101 performs central control on MFP 100 for a variety of jobs such as a scan job, a copy job, a mail transmission job, and a print job. CPU 101 also executes a control program stored in ROM 102. CPU 101 performs predetermined processing to read data from ROM 102 or RAM 103 and write data into ROM 102 or RAM 103.

ROM 102 is, for example, a flash ROM (Flash Memory). A variety of programs for operating MFP 100 and a variety of fixed data are stored in ROM 102. ROM 102 may be non-rewritable.

RAM 103 is a main memory of CPU 101. RAM 103 is used to temporarily store data necessary for CPU 101 to execute a control program, and image data.

Storage unit 104 is, for example, an HDD (Hard Disk Drive) and stores device installation information or a variety of data related to operation of MFP 100.

Print processing unit 105 performs print processing on paper based on image data processed by image processing unit 106.

Image processing unit 106 performs, for example, an RIP (Raster Image Processing) process for print data or a conversion process of converting the format of data to be transmitted to the outside.

Operation panel 107 includes a key input unit including a ten keypad, a start key, etc. and a display unit including a touch panel display and accepts a variety of input operations, for example, to execute a variety of jobs in MFP 100 from a user. Operation panel 107 also displays a variety of setting items for MFP 100 and messages to a user.

Scanner unit 108 reads a document image.

Network connection unit 109 communicates with external equipment (not shown) via a communication protocol such as TCP/IP in accordance with an instruction from CPU 101.

Cleaning control unit 110 controls each of cleaning devices 15, 23, and 34 described later.

Figure 2:
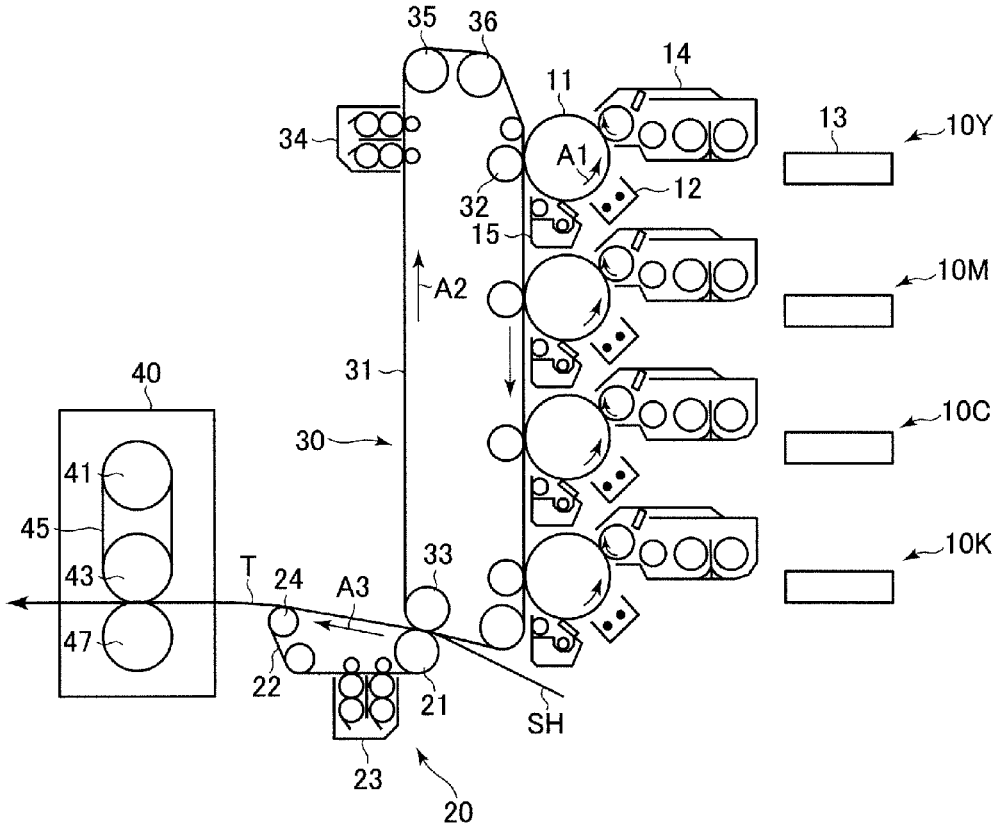
FIG. 2 is a cross-sectional view conceptually showing a main configuration of MFP 100 according to an embodiment of the present invention.

FIG. 2 is a cross-sectional view conceptually showing a main configuration of MFP 100 according to an embodiment of the present invention.

Referring to FIG. 2, MFP 100 has a tandem configuration and forms a color image on paper by combining four color images of YMCK (yellow (Y), magenta (M), cyan (C), and black (K)) as necessary. MFP 100 includes Y, M, C and K imaging units 10Y, 10M, 10C, and 10K (hereinafter also collectively called imaging units 10), a secondary transfer device 20, an intermediate transfer unit 30, and a fixing device 40.

Imaging units 10 are arranged in line along intermediate transfer belt 31. Each imaging unit 10 is arranged to be opposed to a primary transfer roller 32 corresponding to the imaging unit 10. Each imaging unit 10 includes a photoconductor drum 11, a charging device 12, an exposure device 13, a development device 14, and a cleaning device (photoconductor drum cleaning device) 15. The cylindrical photoconductor drum 11 rotates in the direction shown by arrow Al. Charging device 12, exposure device 13, development device 14, and cleaning device 15 are arranged on the periphery of photoconductor drum 11. Cleaning device 15 is in contact with photoconductor drum 11.

Secondary transfer device 20 includes a secondary transfer roller 21, a secondary transfer belt 22, a cleaning device 23 (secondary transfer belt cleaning device), and a plurality of rollers 24. Secondary transfer belt 22 is an endless belt that rotates in the direction shown by arrow A3 and is stretched around a plurality of rollers 24. Secondary transfer belt 22 is in pressure contact with intermediate transfer belt 31 under a predetermined nip pressure. Secondary transfer roller 21 is arranged to be opposed to secondary transfer opposed roller 33 with secondary transfer belt 22 and intermediate transfer belt 31 interposed therebetween. Cleaning device 23 is in contact with secondary transfer belt 22.

Intermediate transfer unit 30 is a device that receives a toner image formed on photoconductor drum 11 to transfer the toner image onto paper SH (recording material) and includes an intermediate transfer belt 31, a primary transfer roller 32, a secondary transfer opposed roller 33, a cleaning device (intermediate transfer belt cleaning device) 34, a driving roller 35, and a stretching roller 36. Intermediate transfer belt 31 is an endless belt that rotates in the direction shown by arrow A2. Intermediate transfer belt 31 is stretched around a plurality of rollers such as secondary transfer opposed roller 33, driving roller 35, and stretching roller 36 and is arranged in contact with both photoconductor drum 11 and paper SH. Driving roller 35 drives intermediate transfer belt 31. Stretching roller 36 adjusts the tension of intermediate transfer belt 31. Secondary transfer opposed roller 33 is opposed to secondary transfer roller 21. Cleaning device 34 is in contact with intermediate transfer belt 31.

Fixing device 40 includes a heating roller 41, a fixing roller 43, a fixing belt 45, and a pressing roller 47. Heating roller 41 contains a heater (not shown). Fixing roller 43 is provided between heating roller 41 and pressing roller 47. Fixing belt 45 is wound around heating roller 41 and fixing roller 43. Fixing device 40 thermally fuses toner adhering to paper SH and fixes the toner on paper by heating and pressing paper SH with fixing belt 45 and pressing roller 47 while conveying paper.

MFP 100 forms an electrostatic latent image on photoconductor drum 11 by charging photoconductor drum 11 using charging device 12 and thereafter performing optical write using exposure device 13. MFP 100 then develops the electrostatic latent image with toner of developing device 14 into a visible image and forms a toner image on photoconductor drum 11. MFP 100 then electrostatically transfers (primary transfer) the toner image on photoconductor drum 11 onto intermediate transfer belt 31 by applying voltage between photoconductor drum 11 and primary transfer roller 32 and conveys the toner image to secondary transfer device 20 using intermediate transfer belt 31. In forming a color image, MFP 100 forms Y, M, C, and K toner images on the respective photoconductor drums 11 of imaging units 10 and successively transfers the toner images from imaging units 10 onto intermediate transfer belt 31. A color toner image in which toner images in multiple colors are superimposed is thus formed on intermediate transfer belt 31. MFP 100 then electrostatically transfers (secondary transfer) the toner image on intermediate transfer belt 31 onto paper SH using secondary transfer belt 22 by allowing paper SH to pass through between intermediate transfer belt 31 and secondary transfer belt 22 along the conveyance direction shown by arrow T. MFP 100 thereafter conveys paper SH having the toner image transferred thereon to fixing device 40 and fixes the toner image using fixing device 40. An image is thus formed on paper SH.

Cleaning device 15 is provided between primary transfer roller 32 and charging device 12 along the outer periphery of photoconductor drum 11. Cleaning device 15 removes toner or paper dust left on the surface of photoconductor drum 11 after primary transfer.

Cleaning device 23 is provided on the outer periphery of secondary transfer belt 22. Cleaning device 23 removes toner or paper dust left on the surface of secondary transfer belt 22.

Cleaning device 34 is provided between secondary transfer opposed roller 33 and driving roller 35 along intermediate transfer belt 31. Cleaning device 34 removes toner or paper dust left on the surface of intermediate transfer belt 31 after secondary transfer.

In addition to forming a normal image, imaging unit 10 forms a patch image (patch pattern) on photoconductor drum 11 at a predetermined timing for the purpose of registration of a toner image, density control, or forced consumption of toner for preventing image deterioration due to toner degradation when low coverage images are continuously printed. The patch image is formed in a non-image region existing between two image regions (regions where toner images to be transferred onto paper are formed) on photoconductor drum 11.

Among the purposes as described above, in particular, in the case of forced consumption of toner, the amount of adhering patch toner of a patch image is the largest. In this case, the amount of adhering patch toner per unit area is about, for example, 3 $g/m^2$ to 10 $g/cm^2$, which is equivalent to solid images of one or two colors. If patch images are formed between all the image regions, patch images intermittently come into contact with the cleaning device at intervals of 0.5 seconds to 2 seconds. The width in the axial direction (the direction vertical to the direction in which the image carrier moves) of a patch image is almost equal to the entire width of the image region, and the length in the direction orthogonal to the axis (the direction in which the image carrier moves) is about 1 cm to 10 cm. Imaging units 10 may form patch images such that Y, M, C, and K patch images are successively arranged on the image carrier, or may form patch images of some colors.

The patch image is formed in the same manner as in forming a solid image in normal image formation. Specifically, when a patch image is formed, imaging unit 10 performs optical write on photoconductor drum 11 in a similar manner as in normal image formation thereby forming a solid image having a desired width and length.

Patch toner of the patch image formed on photoconductor drum 11 is transferred from photoconductor drum 11 onto intermediate transfer belt 31, then transferred from intermediate transfer belt 31 onto secondary transfer belt 22, and then removed by cleaning device 23 from secondary transfer belt 22.

The patch toner of the patch image formed on photoconductor drum 11 may be removed on photoconductor drum 11 using cleaning device 15 or may be removed on intermediate transfer belt 31 using cleaning device 34. The patch image may be partially transferred from intermediate transfer belt 31 onto secondary transfer belt 22, so that the patch toner on secondary transfer belt 22 and the patch toner left on intermediate transfer belt 31 are removed using the respective cleaning devices 23 and 34.

The detailed configuration of cleaning device 23 will now be described.

Figure 3:
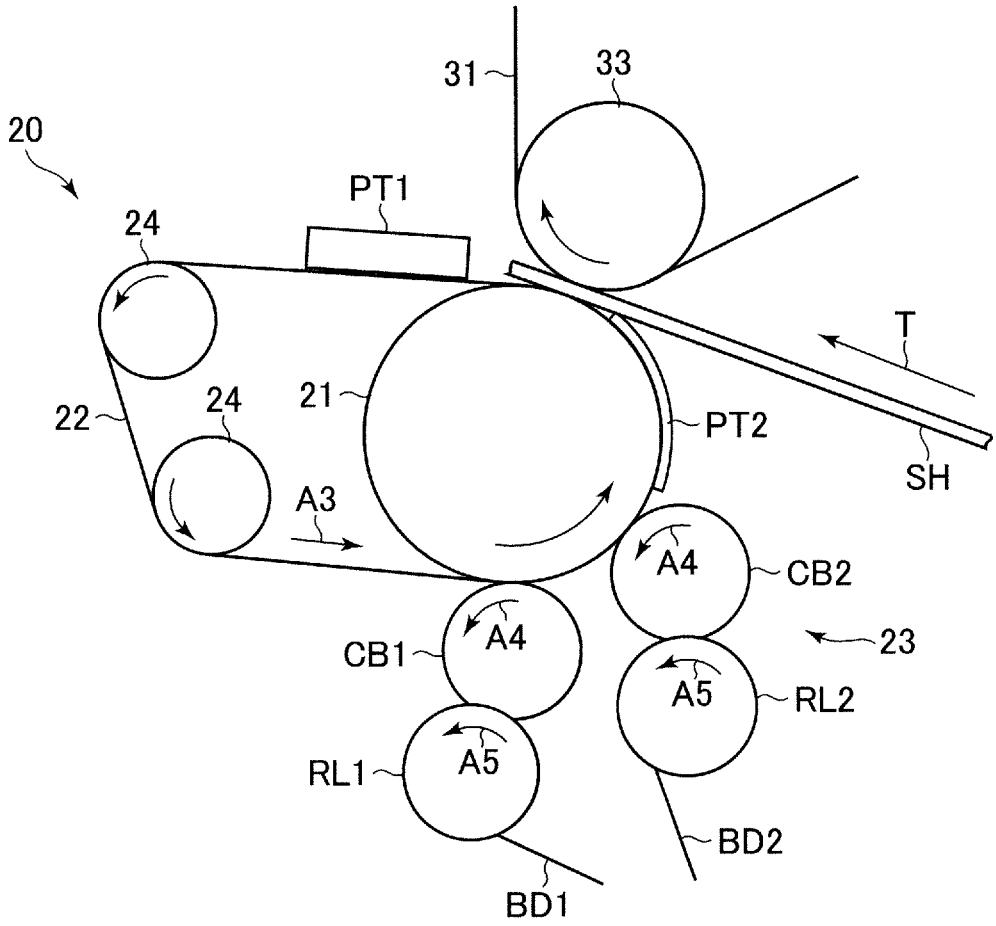
FIG. 3 is a cross-sectional view showing a detailed configuration of a cleaning device 23.

FIG. 3 is a cross-sectional view showing a detailed configuration of cleaning device 23. Cleaning device 15 or 34 may also have the configuration in FIG. 3.

Referring to FIG. 3, cleaning device 23 includes an upstream brush CB1 (an example of a first rotator), a downstream brush CB2 (an example of a second rotator), an upstream recovering roller RL1, a downstream recovering roller RL2, an upstream blade BD1, and a downstream blade BD2.

Upstream brush CB1 and downstream brush CB2 are each, for example, a brush roller and are arranged in parallel to secondary transfer roller 21 opposed thereto with secondary transfer belt 22 interposed therebetween. Downstream brush CB2 is arranged downstream from upstream brush CB1 along the rotational direction of secondary transfer belt 22 as shown by arrow A3. Upstream brush CB1 and downstream brush CB2 are each in contact with secondary transfer belt 22. Upstream brush CB1 and downstream brush CB2 come into contact with secondary transfer belt 22 in a rotating state to remove patch toner of a patch image from on secondary transfer belt 22. Upstream brush CB1 and downstream brush CB2 each can rotate in the direction shown by arrow A4. The rotational direction of upstream brush CB1 and downstream brush CB2 is preferably opposed to the rotational direction (the direction of moving) of secondary transfer belt 22. Upstream brush CB1 and downstream brush CB2 are connected to a motor (not shown) and driven to rotate by motive force of the motor under the control of cleaning control unit 110. The diameter of upstream brush CB1 and the diameter of downstream brush CB2 are preferably different from each other.

Upstream recovering roller RL1 and downstream recovering roller RL2 each can rotate in the direction shown by arrow AS and are in contact with upstream brush CB1 and downstream brush CB2, respectively. Upstream blade BD1 and downstream blade BD2 are in contact with upstream recovering roller RL1 and downstream recovering roller RL2, respectively.

The following description of the configuration of the cleaning device is typically related to cleaning device 23. It should be understood, however, that the description is applicable to the configuration of any cleaning device, irrespective of a place where patch toner is to be removed. For this reason, an image carrier that carries patch toner to be removed (photoconductor drum 11, intermediate transfer belt 31, or secondary transfer belt 22 in FIG. 2) is also called "transfer belt," and two rotators (upstream brush CB1 and downstream brush CB2 in FIG. 3) for removing a patch image from the image carrier are each called "brush roller." The brush roller on the upstream side (upstream brush CB1 in FIG. 3) and the brush roller on the downstream side (downstream brush CB2 in FIG. 3) are also called "upstream brush" and "downstream brush," respectively. The recovering roller (upstream recovering roller RL1 in FIG. 3) in contact with the upstream brush and the recovering roller (downstream recovering roller RL2 in FIG. 3) in contact with the downstream brush are also called "upstream recovering roller" and "downstream recovering roller," respectively.

Preferably, the moving speed (peripheral speed) of the brush roller is decided based on the moving speed of the transfer belt. Specifically, the value of the speed ratio (peripheral speed ratio) $\theta$ (=Vb/Va), which is the ratio of the moving speed Vb of the brush roller to the moving speed Va of the transfer belt, is preferably 0.3 or more and 2 or less. The speed ratio 0 of 0.3 or more can ensure a sufficient scraping force for adhesion on the transfer belt. On the other hand, the speed ratio of 2 or less can prevent excessive load from being exerted on the brush roller, the recovering roller, or the transfer belt.

Preferably, the amount of pressing the brush roller against the transfer belt is generally 10% or higher and 40% or lower of the pile length of the brush of the brush roller. The amount of pressing may be set by cleaning control unit 110 or may be a fixed value. The amount of pressing of 10% or higher can ensure a sufficient scraping force for adhesion on the transfer belt. On the other hand, the amount of pressing of 40% or lower can prevent excessive load from being exerted on the brush roller, the recovering roller, or the transfer belt.

The brush roller includes a core and a brush (brush layer) covering the outer peripheral of the core. The brush roller is fabricated by weaving conductive brush fibers (threads) into an entirely conductive cloth or a conductive cloth coated with a conductive agent on a back surface thereof, and winding the cloth woven with the brush fibers around the core, and bonding the cloth and the core together using a conductive adhesive so as to establish continuity between the cloth and the core.

Examples of the material of the brush roller include nylon-based, polyester-based, acrylic-based, rayon-based, and other various materials. The thickness of the fibers of the brush roller is preferably 1 denier or more and 10 denier or less. The brush density of the brush roller is approximately 50 kf/inch$^2$ or more and 300 kf/inch$^2$ or less. The fiber thickness of 1 denier or more or the brush density of 50 kf/inch$^2$ or more can achieve a sufficient scraping force. The fiber thickness of 10 denier or less or the brush density of 300 kf/inch$^2$ or less can prevent load on the transfer belt and can prevent damage (scratch or abrasion) to the transfer belt surface. The higher brush density deteriorates discharging of the captured foreign substances, although the scraping force is increased, making it difficult to keep performance for long time.

In order to form a predetermined electric field between the transfer belt and the brush roller, the brush of the brush roller is preferably conductive. The thread resistivity of the brush is preferably $10^5$ Ωcm or higher and $10^{13}$ Ωcm or lower. The addition of a conductive material in the material of the fiber can impart conductivity to the brush and achieve a desired resistivity. Examples of the conductive material that can be used include conductive carbon black, various ion conductive materials, and other known conductive materials. The thread resistivity (volume resistivity) of $10^5$ Ωcm or higher reduces the possibility of leakage of the electric field at the portion where the contact gap with the transfer belt is small, and can prevent damage to the brush or the transfer belt. On the other hand, the thread resistivity (volume resistivity) of $10^{13}$ Ωcm or lower can reduce the voltage of the power supply and can suppress cost increase or size increase of the power supply.

In order to remove toner on the transfer belt by electrostatic effects, cleaning control unit 110 forms an electric field such that toner is successively moved between the transfer belt and the brush roller and between the brush roller and the recovering roller. The electric field can be formed by any method. For example, the recovering roller and the brush roller may be connected to a high-voltage power supply, and the cleaning opposed roller may be connected to GND. The method of controlling voltage may be constant voltage control or constant current control.

Preferably, cleaning control unit 110 applies bias in the direction of drawing the normally charged toner to the upstream brush and the upstream recovering roller and applies bias in the direction of drawing the toner charged oppositely to the normal charge to the downstream brush and the downstream recovering roller. Accordingly, even when the patch toner to be removed has a broad charge distribution extending from the normally charged toner to the oppositely charged toner, the toner can be removed from on the transfer belt without any problem.

A metal roller is preferably used as the recovering roller. A metal blade is preferably used as the blade (scraping member). A metal roller is preferably used as the cleaning opposed roller that is opposed to the brush roller.

Any transfer belt can be used as the intermediate transfer belt or the secondary transfer belt. The transfer belt is preferably an endless belt that is adjusted to have a volume resistivity of $10^5$ to $10^{12}$ Ωcm by adding a conductive agent to resin such as polyimide, polycarbonate, or polyester, or various rubbers.

[Cause of Image Noise in Conventional Technique]

The present inventors examined the cause of image noise in a conventional technique as follows.

Referring to FIG. 3, patch toner PT1 transferred to a non-image region existing between two image regions on secondary transfer belt 22 is removed by cleaning device 23. The toner on secondary transfer belt 22, however, is partially not removed by cleaning device 23 and becomes poor cleaning toner PT2. Poor cleaning toner PT2 is transferred onto the back surface of paper SH at the nip section (secondary transfer section) between secondary transfer belt 22 and intermediate transfer belt 31 and becomes image noise (back surface stain).

Figure 4:
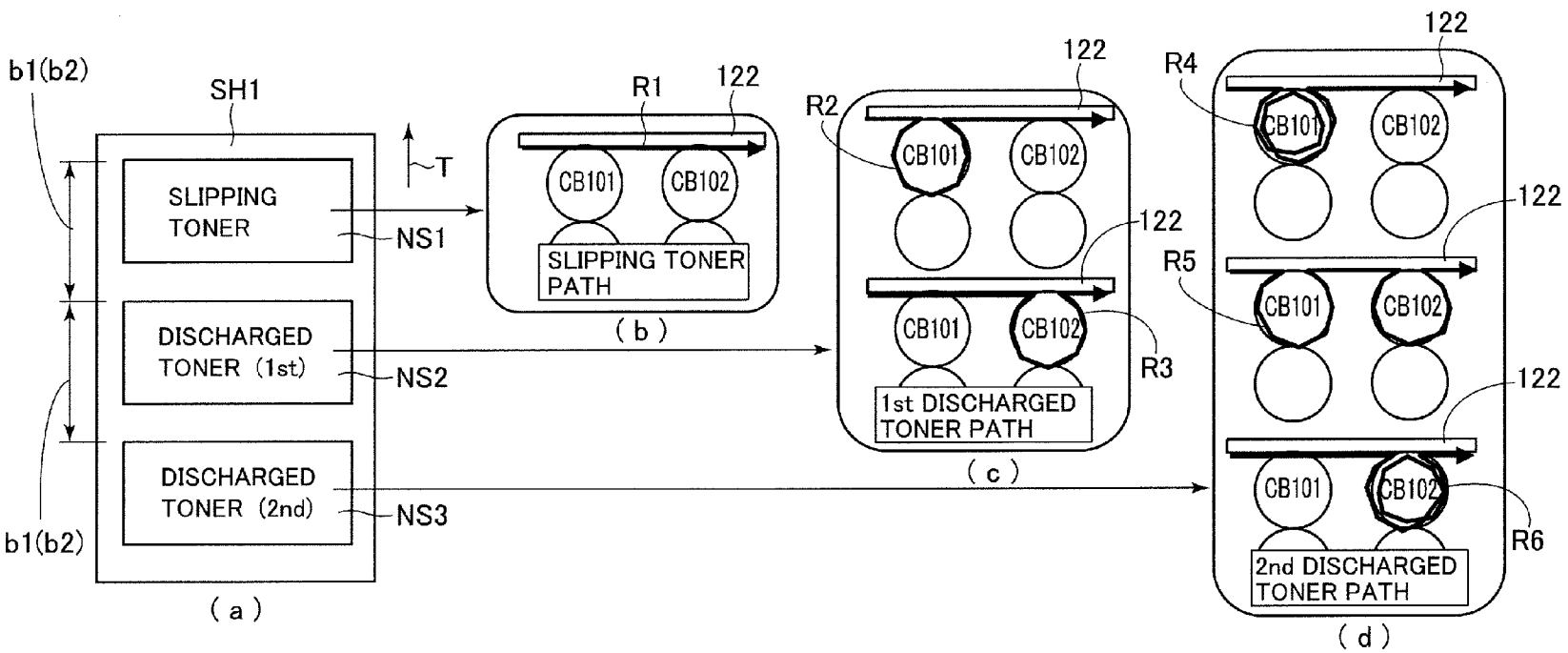
FIG. 4 is a diagram schematically showing the relationship between image noise caused in a conventional technique and a movement path of poor cleaning toner.

FIG. 4 is a diagram schematically showing the relationship between image noise caused in a conventional technique and a movement path of poor cleaning toner.

Referring to FIG. 4, poor cleaning toner includes slipping toner and discharged toner. The places on paper where poor cleaning toner adheres vary with movement paths of poor cleaning toner.

Slipping toner is toner that is not recovered by upstream brush CB101 and downstream brush CB 102 and slips through upstream brush CB101 and downstream brush CB102, as shown in FIG. 4(*b*). Slipping toner does not move around the outer periphery of upstream brush CB101 and downstream brush CB102. Therefore, a movement path R1 of slipping toner is short.

On the other hand, discharged toner is toner that is recovered once by upstream brush CB101 or downstream brush CB102, rotates around the outer periphery of upstream brush CB101 or downstream brush CB102 with the rotation of upstream brush CB101 or downstream brush CB102, and is thereafter discharged (re-transferred) to secondary transfer belt 122, as shown in FIG. 4(*c*) and FIG. 4(*d*).

Discharged toner includes the following two types of toner: discharged toner (this discharged toner is hereinafter also called first discharged toner) that makes one turn around the outer periphery of upstream brush CB101 or downstream brush CB102 and is thereafter discharged to secondary transfer belt 122, as shown in FIG. 4(*c*); and discharged toner (this discharged toner is hereinafter also called second discharged toner) that makes two turns around the outer periphery of upstream brush CB101 or downstream brush CB102 and is thereafter discharged to secondary transfer belt 122, as shown in FIG. 4(*d*).

The first discharged toner is the one that moves through the path (movement path R2) of making one turn around the outer periphery of upstream brush CB101 and thereafter slipping through downstream brush CB102, or the one that moves through the path (movement path R3) of slipping through upstream brush CB101 and thereafter making one turn around the outer periphery of downstream brush CB102, as shown in FIG. 4(*c*).

The second discharged toner is the one that moves through the path (movement path R4) of making two turns around the outer periphery of upstream brush CB101 and thereafter slipping through downstream brush CB102, the one that moves through the path (movement path R5) of making one turn around the respective outer peripheries of upstream brush CB101 and downstream brush CB102, or the one that moves through the path (movement path R6) of slipping through upstream brush CB101 and thereafter making two turns around the outer periphery of downstream brush CB102, as shown in FIG. 4(*d*).

Here, it is assumed that the distance b1 and the distance b2 are equal to each other (distances b1=b2). For example, this is the case where upstream brush CB101 and downstream brush CB102 have the same diameter and rotate at the same peripheral speed.

In this case, as shown in FIG. 4(*a*), image noises NS1 to NS3 of the visually recognizable level periodically occur on back surface SH1 of paper. Image noises NS1 to NS3 are each rectangular and have almost the same width (the lateral length in FIG. 4(*a*)) and height (the longitudinal length in FIG. 4(*a*)) along the paper conveyance direction shown by arrow T.

Image noise NS1 is caused by slipping toner. Movement path R1 of slipping toner is short so that image noise NS1 caused by slipping toner appears most upstream along the conveyance direction among image noises NS1 to NS3.

Image noise NS2 is formed by the first discharged toner overlapping each other to locally adhere to a part of paper. That is, when the distance b1 and the distance b2 are equal, the toner moving through movement path R2 and the toner moving through movement path R3 adhere to the same position on secondary transfer belt 122. As a result, theses toners overlap each other and adhere at the same position on back surface SH1 of paper to form image noise NS2. Image noise NS2 occurs downstream from image noise NS1 by the distance b1 (or distance b2). Image noise NS2 is generally the most serious noise among image noises NS1 to NS3.

Image noise NS3 is formed by the second discharged toner overlapping each other to locally adhere to a part of paper. That is, when the distance b1 and the distance b2 are equal, the toner moving through movement path R4, the toner moving through movement path R5, and the toner moving through movement path R6 adhere at the same position secondary transfer belt 122. As a result, these toners overlap each other and adhere at the same position on back surface SH1 of paper to form image noise NS3. Image noise NS3 occurs downstream from image noise NS2 by the distance b1 (or distance b2).

In theory, there exists discharged toner that makes three or more turns around the outer periphery of upstream brush CB101 or downstream brush CB102. In actuality, however, the amount of such discharged toner is so small that it will suffice to examine up to the second discharged toner as described above.

Figure 5:
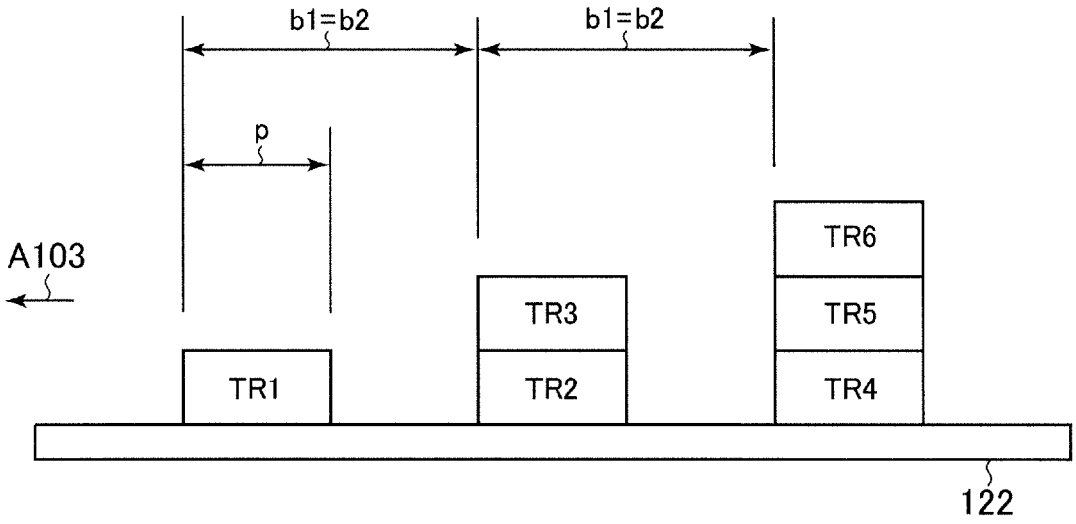
FIG. 5 is a cross-sectional view schematically showing poor cleaning toner adhering to a secondary transfer belt 122 in a conventional technique.

FIG. 5 is a cross-sectional view schematically showing poor cleaning toner adhering to secondary transfer belt 122 in a conventional technique. FIG. 5 is a cross-sectional view of secondary transfer belt 122 cut along the rotational direction of secondary transfer belt 122 as shown by arrow A103.

Referring to FIG. 5, it is toner TR1 (slipping toner) moving through movement path R1 that adheres to the most upstream position on secondary transfer belt 122. The length of toner TR1 is the length p of the original patch image (the length of the patch image formed by imaging unit 10 on photoconductor drum 11). Here, the length p of the patch image means the length of the patch image along the rotational direction of the secondary transfer belt.

Toner TR2 (the first discharged toner) moving through movement path R2 adheres at a position downstream from toner TR1 by the distance b1 on secondary transfer belt 122. Toner TR3 (the first discharged toner) moving through movement path R3 adheres at a position downstream from toner TR1 by the distance b2 on secondary transfer belt 122. When the distances b1 and b2 are equal to each other, toners TR2 and TR3 overlap each other. The lengths of toners TR2 and TR3 are the length p of the patch image.

Toner TR4 (the second discharged toner) moving through movement path R4 adheres at a position downstream from toner TR1 by the distance {(b1)×2} on secondary transfer belt 122. Toner TR5 (the second discharged toner) moving through movement path R5 adheres at a position downstream from toner TR1 by the distance (b1+b2) on secondary transfer belt 122. Toner TR6 (the second discharged toner) moving through movement path R6 adheres at a position downstream from toner TR1 by the distance {(b2)×2} on secondary transfer belt 122. When the distances b1 and b2 are equal to each other, toners TR4, TR5, and TR6 overlap each other. The lengths of toners TR4, TR5, and TR6 are the length p of the patch image.

As a result of examination as described above, the present inventors found that poor cleaning toners moving along different movement paths adhere to the same position on the transfer belt, resulting in that the amount of adherence of poor cleaning toner becomes locally large at a part on the transfer belt, and the poor cleaning toner at that part adheres to paper to cause image noise at the visually recognizable level.

[Relational Expressions Satisfied by Length p of Patch Image and Distances b1 and b2]

Based on the cause as described above, in MFP 100, the length p of the patch image and the distances b1 and b2 are set so as to satisfy such a condition that toner TR2 moving through movement path R2 and toner TR3 moving through movement path R3 do not overlap on secondary transfer belt 22 (such that they adhere at different positions on secondary transfer belt 22). This condition is called the first condition. Image noise NS2, which is the most serious noise among image noises NS1 to NS3, can be prevented by satisfying the first condition.

The length p of the patch image and the distances b1 and b2 each can be set as an initial value, for example, during production of MFP 100.

To satisfy the first condition, the length p of the patch image and the distances b1 and b2 satisfy the expression (1) below.

$$p \leq |b1-b2| \quad (1)$$

A method of deriving the expression (1) is described below.

Figure 6:
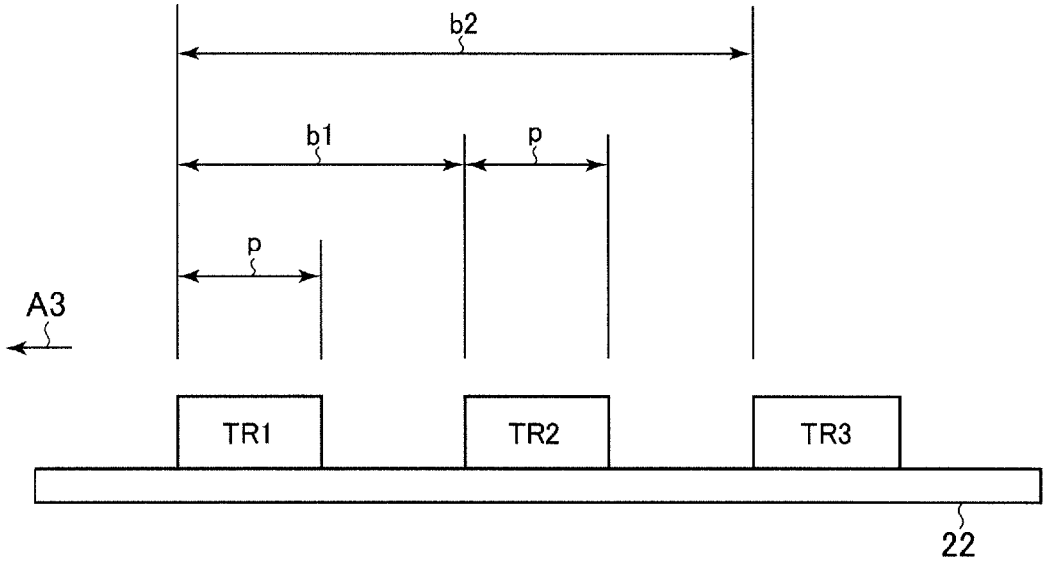
FIG. 6 is a cross-sectional view schematically showing poor cleaning toner in a case where toner TR2 and toner TR3 do not overlap on secondary transfer belt 22.

FIG. 6 is a cross-sectional view schematically showing poor cleaning toner in a case where toner TR2 and toner TR3 do not overlap on secondary transfer belt 22. It is noted that FIGS. 6 to 11, FIG. 13, and FIG. 14 are cross-sectional views of secondary transfer belt 22 cut along the rotational direction of secondary transfer belt 22 shown by arrow A3.

Referring to FIG. 6, when the upstream end of toner TR1 is the origin, the coordinate of the upstream end of toner TR2 is represented by a coordinate b1, the coordinate of the downstream end of toner TR2 is represented by a coordinate (b1+p), and the coordinate of the upstream end of toner TR3 is represented by a coordinate b2. Therefore, when toner TR2 adheres upstream from toner TR3 (where b1<b2), the length p of the patch image and the distances b1 and b2 should satisfy the following expression (1A) so that toner TR2 and toner TR3 do not overlap on secondary transfer belt 22.

$$b1+p \leq b2 \quad (1A)$$

The expression (1A) is transformed to yield the following expression (1B).

$$p \leq b2-b1 \quad (1B)$$

Similarly, when toner TR2 adheres downstream from toner TR3 (where b1>b2), the length p of the patch image and the distances b1 and b2 should satisfy the following expression (1C) so that toner TR2 and toner TR3 do not overlap on secondary transfer belt 22.

$$b2+p \leq b1 \quad (1C)$$

The expression (1C) is transformed to yield the following expression (1D).

$$p \leq b1-b2 \quad (1D)$$

The expression (1B) and the expression (1D) can be combined to yield the expression (1).

Next, the preferred relational expression to be satisfied by the length p of the patch image and the distances b1 and b2 will be described, where poor cleaning toner satisfies each of the following second to sixth conditions:

the second condition: a condition that toner TR2 and toner TR4 do not overlap;

the third condition: a condition that toner TR2 and toner TR5 do not overlap;

the fourth condition: a condition that toner TR3 and toner TR5 do not overlap;

the fifth condition: a condition that toner TR4 and toner TR5 do not overlap; and the sixth condition: a condition that toner TR5 and toner TR6 do not overlap.

In order that poor cleaning toner satisfies the second condition, it is preferable that the length p of the patch image and the distances b1 an b2 should satisfy the following expression (2).

$$p \leq b1 \quad (2)$$

A method of deriving the expression (2) is described below.

Figure 7:
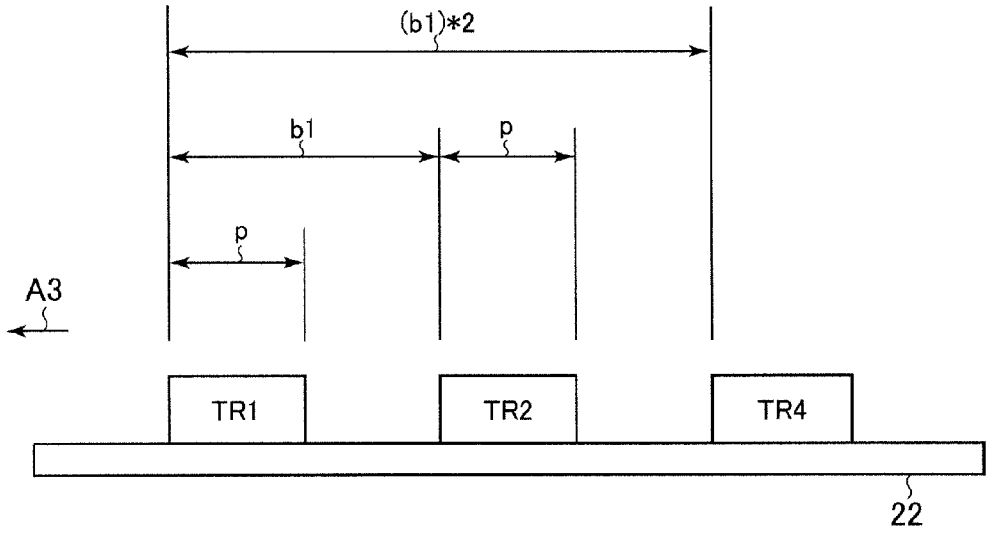
FIG. 7 is a cross-sectional view schematically showing poor cleaning toner in a case where toner TR2 and toner TR4 do not overlap on secondary transfer belt 22.

FIG. 7 is a cross-sectional view schematically showing poor cleaning toner in a case where toner TR2 and toner TR4 do not overlap on secondary transfer belt 22.

Referring to FIG. 7, when the upstream end of toner TR1 is the origin, the coordinate of the downstream end of toner TR2 is represented by a coordinate (b1+p), and the coordinate of the upstream end of toner TR4 is represented by a coordinate (b1)×2. Therefore, the length p of the patch image and the distances b1 and b2 should satisfy the following expression (2A) so that toner TR2 and toner TR4 do not overlap on secondary transfer belt 22.

$$b1+p\leq(b1)\times2 \tag{2A}$$

The expression (2A) is transformed to yield the expression (2).

In addition, in order that poor cleaning toner satisfies the third condition, the length p of the patch image and the distances b1 and b2 should further satisfy the following expression (3).

$$p\leq b2 \tag{3}$$

A method of deriving the expression (3) is described below.

Figure 8:
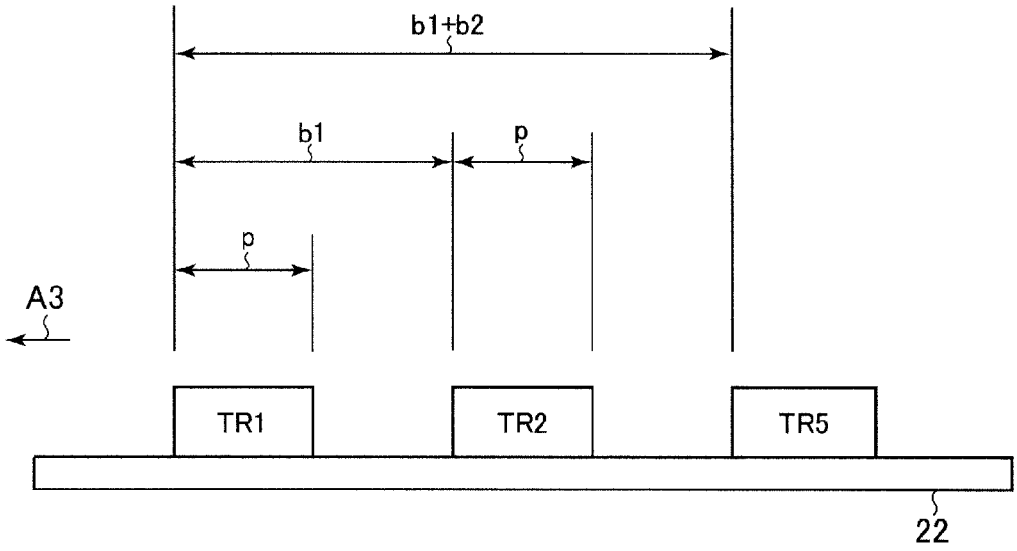
FIG. 8 is a cross-sectional view schematically showing poor cleaning toner in a case where toner TR2 and toner TR5 do not overlap on secondary transfer belt 22.

FIG. 8 is a cross-sectional view schematically showing poor cleaning toner in a case where toner TR2 and toner TR5 do not overlap on secondary transfer belt 22.

Referring to FIG. 8, when the upstream end of toner TR1 is the origin, the coordinate of the downstream end of toner TR2 is represented by a coordinate (b1+p), and the coordinate of the upstream end of toner TR5 is represented by a coordinate (b1+b2). Therefore, the length p of the patch image and the distances b1 and b2 should satisfy the following expression (3A) so that toner TR2 and toner TR5 do not overlap on secondary transfer belt 22.

$$b1+p\leq b1+b2 \tag{3A}$$

The expression (3A) is transformed to yield the expression (3).

In order that poor cleaning toner satisfies the fourth condition, the length p of the patch image and the distances b1 and b2 should satisfy the expression (2).

Figure 9:
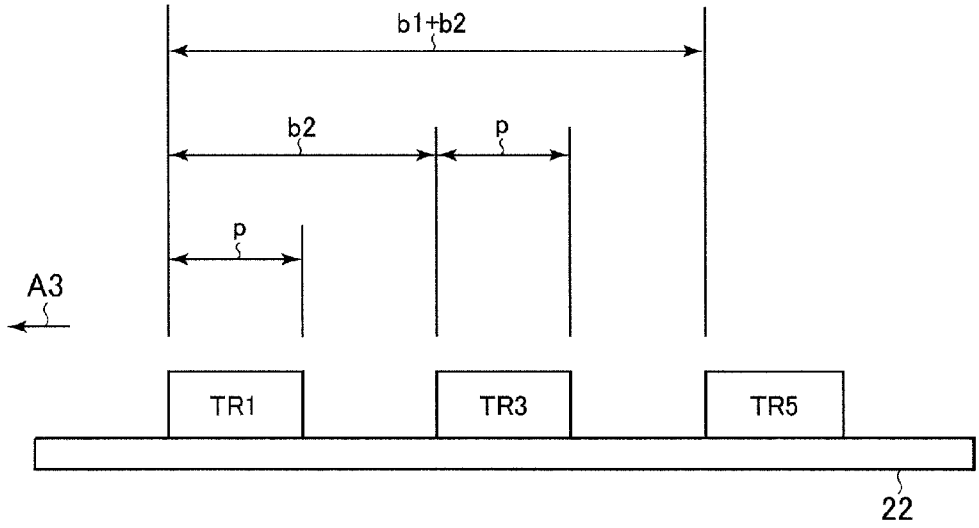
FIG. 9 is a cross-sectional view schematically showing poor cleaning toner in a case where toner TR3 and toner TR5 do not overlap on secondary transfer belt 22.

FIG. 9 is a cross-sectional view schematically showing poor cleaning toner in a case where toner TR3 and toner TR5 do not overlap on secondary transfer belt 22.

Referring to FIG. 9, when the upstream end of toner TR1 is the origin, the coordinate of the downstream end of toner TR3 is represented by a coordinate (b2+p), and the coordinate of the upstream end of toner TR5 is represented by a coordinate (b1+b2). Therefore, the length p of the patch image and the distances b1 and b2 should satisfy the following expression (2B) so that toner TR3 and toner TR5 do not overlap on secondary transfer belt 22.

$$b2+p\leq b1+b2 \tag{2B}$$

The expression (2B) is transformed to yield the expression (2).

In order that poor cleaning toner satisfies the fifth condition, the length p of the patch image and the distances b1 and b2 should satisfy the expression (1).

Figure 10:
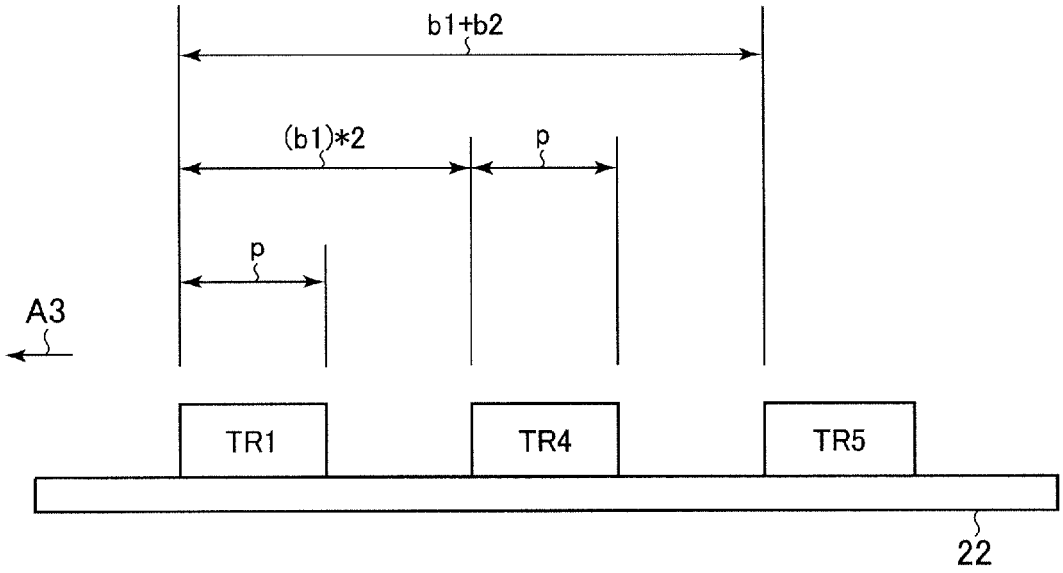
FIG. 10 is a cross-sectional view schematically showing poor cleaning toner in a case where toner TR4 and toner TR5 do not overlap on secondary transfer belt 22.

FIG. 10 is a cross-sectional view schematically showing poor cleaning toner in a case where toner TR4 and toner TR5 do not overlap on secondary transfer belt 22.

Referring to FIG. 10, when the upstream end of toner TR1 is the origin, the coordinate of the downstream end of toner TR4 is represented by a coordinate {(b1)×2+p}, and the coordinate of the upstream end of toner TR5 is represented by a coordinate (b1+b2). Therefore, the length p of the patch image and the distances b1 and b2 should satisfy the following expression (1E) so that toner TR4 and toner TR5 do not overlap on secondary transfer belt 22.

$$(b1)\times2+p\leq b1+b2 \tag{1E}$$

The expression (1E) is transformed to yield the expression (1B). The expression (1E) is thus included in the expression (1).

In order that poor cleaning toner satisfies the sixth condition, the length p of the patch image and the distances b1 and b2 should satisfy the expression (1).

Figure 11:
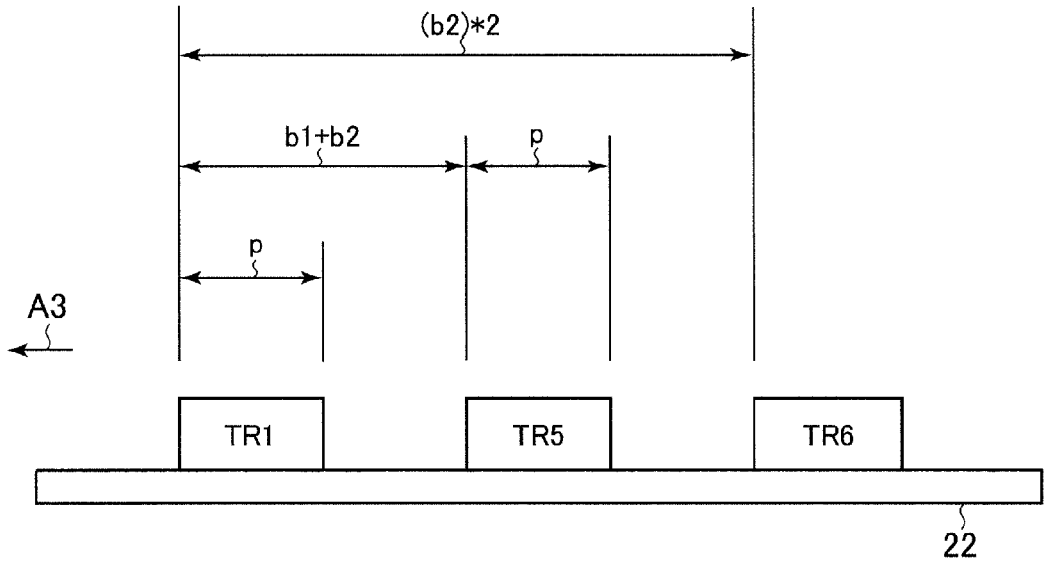
FIG. 11 is a cross-sectional view schematically showing poor cleaning toner in a case where toner TR5 and toner TR6 do not overlap on secondary transfer belt 22.

FIG. 11 is a cross-sectional view schematically showing poor cleaning toner in a case where toner TR5 and toner TR6 do not overlap on secondary transfer belt 22.

Referring to FIG. 11, when the upstream end of toner TR1 is the origin, the coordinate of the downstream end of toner TR5 is represented by a coordinate (b1+b2+p), and the coordinate of the upstream end of toner TR6 is represented by a coordinate (b2)×2. Therefore, the length p of the patch image and the distances b1 and b2 should satisfy the following expression (1F) so that toner TR5 and toner TR6 do not overlap on secondary transfer belt 22.

$$b1+b2+p\leq(b2)\times2 \tag{1F}$$

The expression (1F) is transformed to yield the expression (1B). The expression (1F) is thus included in the expression (1).

FIG. 12 is a table showing the relational expressions where poor cleaning toner satisfies the first to sixth conditions.

Referring to FIG. 12, if the length p of the patch image and the distances b1 and b2 satisfy the expression (1), overlapping can be avoided in most of the combinations of paths, and the effect of suppressing image noise is high. It is more effective if the length p of the patch image and the distances b1 and b2 additionally satisfy the expression (2) or (3). The effect can be achieved as long as the length p of the patch image and the distances b1 and b2 satisfy the expression (2) or (3) even if the expression (1) is not satisfied. In general, however, the possibility that toners TR2 and TR3 appear is higher than that of toner TR4, TR5, or TR6. The expression (1) (the first condition) thus should precede.

[More Preferred Relational Expression Satisfied by Length p of Patch Image and Distances b1 and b2]

Figure 13:
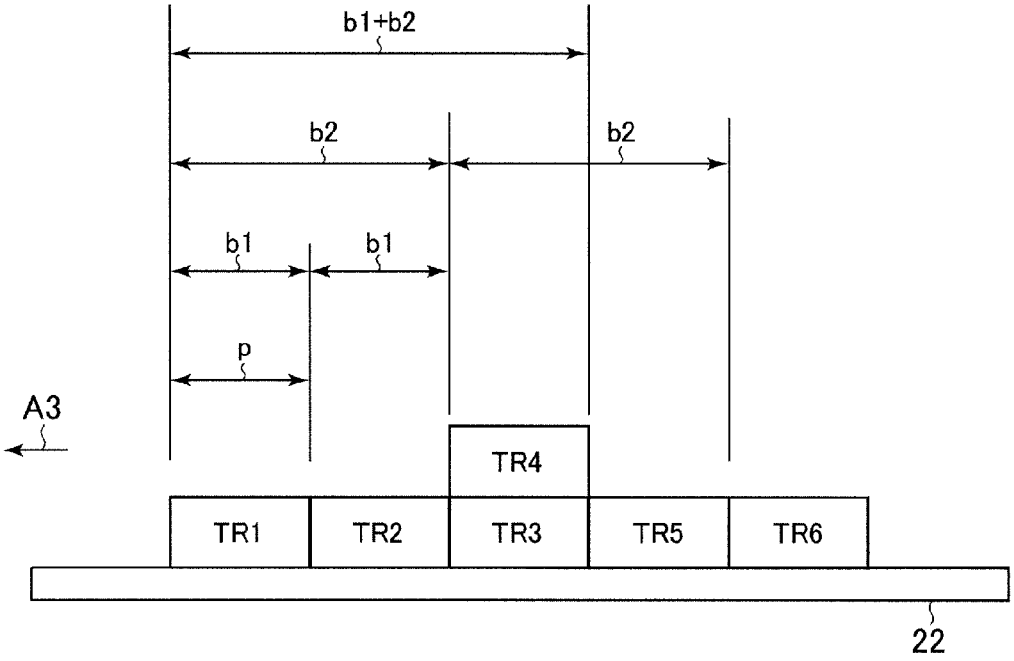
FIG. 13 is a cross-sectional view schematically showing poor cleaning toner on secondary transfer belt 22 when a length p of patch image and distances b1 and b2 satisfy p=(b2−b1) and p=b1.

FIG. 13 is a cross-sectional view schematically showing poor cleaning toner on secondary transfer belt 22 when the length p of the patch image and the distances b1 and b2 satisfy p=(b2−b1) and p=b1.

Referring to FIG. 13, if the length p of the patch image and the distances b1 and b2 are set so as to satisfy the expressions (1) and (2) as described above, overlapping of poor cleaning toner can be mostly avoided. In FIG. 13, it is only toner TR3 and toner TR4 that overlap each other among toner TR1 to TR6.

When p≤(b2−b1), the length p of the patch image is preferably shorter than the distances b1 and b2 in order to further avoid overlapping of toner TR3 and toner TR4. Specifically, it is effective to satisfy the following expression (4).

$$p\leq(b1)/2 \tag{4}$$

Similarly, when p≤(b1−b2), the length p of the patch image is preferably shorter than the distances b1 and b2 in order to further avoid overlapping of toner TR3 and toner TR4. Specifically, it is effective to satisfy the following expression (5).

$$p\leq(b2)/2 \tag{5}$$

When one of the distances b1 and b2 is an integer multiple of the other, the possibility that toner TR3 and toner TR4 or toner TR2 and toner TR4 overlap each other is high. Therefore, the distances b1 and b2 preferably have such a relationship in that one of them is not an integer multiple of the other. Specifically, it is preferable that the distances b1 and b2 should satisfy the following expressions (6) and (7), where n is any given natural number.

$$b1 \neq n \times (b2) \quad (6)$$

$$b2 \neq n \times (b1) \quad (7)$$

Figure 14:
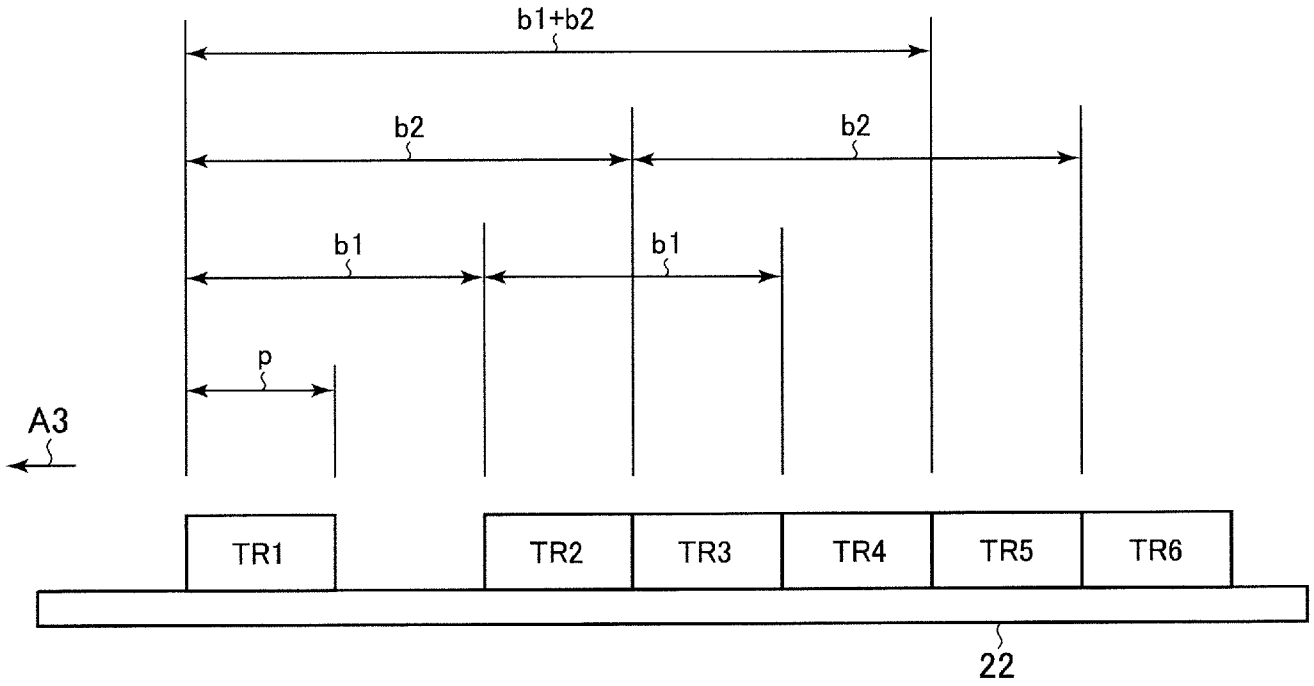
FIG. 14 is a cross-sectional view schematically showing poor cleaning toner on secondary transfer belt 22 when the length p of patch image and distances b1 and b2 satisfy p=(b2−b1) and p=(b1)/2.

FIG. 14 is a cross-sectional view schematically showing poor cleaning toner on secondary transfer belt 22 when the length p of the patch image and the distances b1 and b2 satisfy p=(b2−b1) and p=(b1)/2 (where b2=1.5×b1, and b2≠n×(b1) is also satisfied).

Referring to FIG. 14, the length p of the patch image and the distances b1 and b2 satisfy the expressions (4) and (7), whereby overlapping of all of toners TR1 to TR6 is avoided.

[Method of Setting Distances b1 and b2]

A method of setting the distances b1 and b2 will now be described.

The distance b over which the transfer belt travels while the brush roller makes one turn is determined by the outer peripheral length L (brush outer peripheral length) of the brush roller, the moving speed (brush peripheral speed) Vb of the brush roller, and the moving speed Va of the transfer belt. Specifically, the distance b is represented by the following expression (8).

$$b=(L/Vb)\times Va \quad (8)$$

The brush outer peripheral length L is represented by the following expression (9) using the brush outer diameter d.

$$L=\pi d \quad (9)$$

Here, the moving speed Va of the transfer belt is generally equal to the image forming speed (that is, a system speed).

The speed ratio θ between the moving speed Va of the transfer belt and the moving speed Vb of the brush roller is defined by the following expression (10).

$$\theta=Vb/Va \quad (10)$$

The following expression (11) is derived from the expressions (8), (9), and (10).

$$b=\pi d/\theta \quad (11)$$

That is, according to the expression (11), the distance b over which the transfer belt travels while the brush roller makes one turn is determined only by the brush outer diameter d and the speed ratio θ.

In cleaning device 23 shown in FIG. 3, when the outer diameter of upstream brush CB1 is d1, the outer diameter of downstream brush CB2 is d2, the speed ratio between upstream brush CB1 and secondary transfer belt 22 is θ1, and the speed ratio between downstream brush CB2 and secondary transfer belt 22 is θ2, the difference Δb (=|b2−b1|) between the distance b1 and the distance b2 is represented by the following expression (12).

$$\Delta b=|\{\pi(d1)/\theta 1\}-\{\pi(d2)/\theta 2\}| \quad (12)$$

Accordingly, in order to set the distance b1 and b2 such that the length p of the patch image and the distances b1 and b2 satisfy the expression (1), the outer diameter d1 of the upstream brush CB1, the outer diameter d2 of downstream brush CB2, the moving speed Va of secondary transfer belt 22, the moving speed Vb1 of upstream brush CB1, or the moving speed Vb2 of downstream brush CB2 is adjusted based on the expression (12).

In general, the outer diameter d1 of upstream brush CB1 and the outer diameter d2 of downstream brush CB2 are fixed values because upstream brush CB1 and downstream brush CB2 are fixed. It is therefore preferable to adjust the moving speed Va of secondary transfer belt 22, the moving speed Vb1 of upstream brush CB1, or the moving speed Vb2 of downstream brush CB2. Of course, the outer diameter d1 of the upstream brush or the outer diameter d2 of downstream brush CB2 may be adjusted.

[First Modification]

A first modification of the foregoing embodiment will now be described. In this modification, MFP 100 accepts the setting of the length p of the patch image and adjusts the distances b1 and b2 based on the accepted length p of the patch image.

Figure 15:
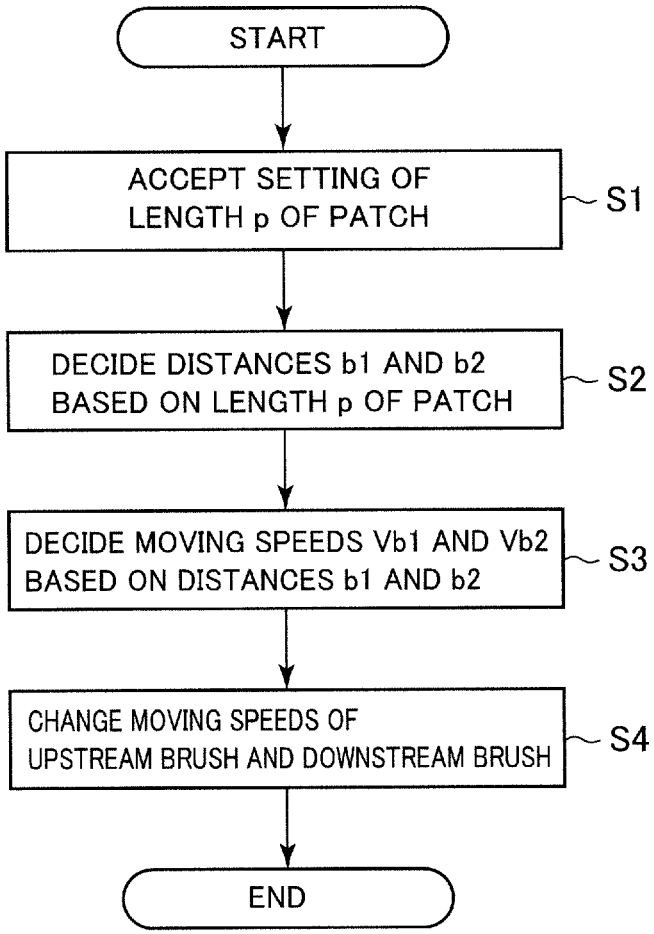
FIG. 15 is a flowchart executed by MFP 100 in a first modification of the present invention.

FIG. 15 is a flowchart executed by MFP 100 in the first modification of the present invention.

Referring to FIG. 15, CPU 101 of MFP 100 accepts the setting of the length p of the patch image (S1). The length p of the patch image may be set by the user through operation panel 107 or the like, or may be decided by CPU 101 based on the installation environment (humidity, temperature, etc.) of MFP 100. The length p may be decided by CPU 101 depending on the purpose of forming a patch image (for example, registration of a toner image, density control, or forced consumption of toner). CPU 101 then decides the distances b1 and b2 such that the length p of the patch image and the distances b1 and b2 satisfy the expression (1) based on the set length p of the patch image (S2). CPU 101 then decides the respective moving speeds Vb1 and Vb2 of upstream brush CB1 and downstream brush CB2 based on the decided distances b1 and b2 (S3). CPU 101 thereafter changes the respective moving speeds of upstream brush CB1 and downstream brush CB2 to the decided moving speeds (S4). The process then ends.

[Second Modification]

A second modification of the foregoing embodiment will now be described. In this modification, MFP 100 selects a particular combination from among a plurality of combinations of the length p of the patch image and the distances b1 and b2, depending on the purpose of forming a patch image.

FIG. 16 is a diagram schematically showing an adjustment table for use in the second modification of the present invention.

Referring to FIG. 16, the adjustment table is stored, for example, in storage unit 104. In the adjustment table, a mode is set for each purpose of forming a patch image. For example, in a case (mode 1) where a patch image is formed for the purpose of registration of a toner image, the length p of the patch image is set to 35 mm, the distances b1 and b2 are set to 50 mm and 101 mm, respectively, and the moving speeds Vb1 and Vb2 are set to 300 mm/sec and 150 mm/sec, respectively. In a case (mode 2) where a patch image is formed for the purpose of density control, the length p of the patch image is set to 25 mm, the distances b1 and b2 are set to 34 mm and 67 mm, respectively, and the moving speeds Vb1 and Vb2 are set to 450 mm/sec and 225 mm/sec, respectively. In a case (mode 3) where a patch image is formed for the purpose of forced consumption of toner, the length p of the patch image is set to 50 mm, the distances b1 and b2 are set to 34 mm and 101 mm, respectively, and the moving speeds Vb1 and Vb2 are set to 450 mm/sec and 150 mm/sec, respectively.

When a patch image is formed, cleaning control unit 110 refers to the adjustment table to decide a mode depending on the purpose of forming a patch image. A patch image is then formed with the length p of the patch image and the moving speeds Vb1 and Vb2 that are set in the decided mode.

In the present modification, at least one of the length p of the patch image, the moving speed Vb1, and the moving speed Vb2 should be adjusted depending on the purpose of forming a patch image.

EXAMPLES

Examples of the present invention will now be described. In this example, an MFP named "bizhub PRO C65" manufactured by Konica Minolta, Inc. was used in which the conditions of the secondary transfer belt cleaning device were changed in Examples 1 to 5 according to the present invention and Comparative Example 1. Other parts of the MFP were not changed nor modified excluding the secondary transfer belt cleaning device. In each of Examples 1 to 5 and Comparative Example 1, a patch image was formed in the MFP and the patch image removed by the secondary transfer belt cleaning device. Standard image output evaluations were performed using paper output from the MFP.

When patch toner of a patch image is removed by the secondary transfer belt cleaning device, poor cleaning toner causes stain on the back surface of paper conveyed after formation of the patch image. Therefore, the cleaning performance can be evaluated by visually evaluating stain on the back surface of paper. The cleaning performance can also be evaluated by stopping the MFP during operation, stripping off the toner adhering to the secondary transfer belt downstream from the secondary transfer belt cleaning device using a book tape, and affixing the stripped toner on paper for optical measurement. In general, when patch toner is black, if the color difference ΔE between the portion where toner adheres most and the portion where no toner adheres is two or less, the toner is hardly visually recognized as image noise even when it adheres to paper.

Example 1

The MFP in Example 1 of the present invention was set such that the length p of the patch image and the distances b1 and b2 satisfied the expression (1).

Specifically, the system speed was set to 300 mm/sec, the amount of adherence of toner was set to 4 g/m$^2$ (equivalent to the amount of adherence of a solid image of one color). The length p of the patch image was set to 70 mm (which is the length of four colors, YMCK, on secondary transfer belt; the length of the patch image for each color was 17.5 mm) The patch image was formed every time an A3-size image was formed. The upstream brush and the downstream brushed used were formed of conductive nylon with the fiber density of 120 KF/inch$^2$ and the thread resistivity of $10^{10}$ Ωcm. The recovering roller used was a metal roller having a diameter of 20 mm. The amount of pressing the upstream brush and the downstream brush against the secondary transfer belt was 1 mm. The secondary transfer belt used was a chloroprene rubber belt with a volume resistivity of $10^8$ •·cm and a thickness of 1 mm.

As for the bias setting, the potential of the cleaning opposed roller was set as GND (ground potential), the potential of the upstream brush was set at +100 V, the potential of the upstream recovering roller was set to +200 V, the potential of the downstream brush was set to −100 V, and the potential of the downstream recovering roller was set to −200 V.

The upstream brush and the downstream brush used had respective outer diameters d1 and d2 of 18 mm. The speed ratio θ1 between the secondary transfer belt and the upstream brush was set such that the moving speed Va of the secondary transfer belt: the moving speed Vb1 of the upstream brush=1:1 (θ1=1). The speed ratio θ2 between the secondary transfer belt and the downstream brush was set such that the moving speed Va of the secondary transfer belt: the moving speed Vb2 of the downstream brush=1:0.4 (θ2=0.4). As a result, the distance b1 was 57 mm, the distance b2 was 141 mm, and the difference Δb between the distance b1 and the distance b2 was 85 mm. The length p of the patch image was set to 70 mm.

A standard image output evaluation was made using paper output from this MFP. Stain on the back surface of paper due to poor cleaning of patch toner was at a permissible level although it was recognizable as image noise with a close look. The poor cleaning toner adhering to the secondary transfer belt was stripped off using a book tape and affixed to paper for optical measurement. As a result, the color difference ΔE between the portion where poor cleaning toner in black adhered most and the portion where no toner adhered was 0.8.

Comparative Example 1

The MFP in Comparative Example 1 was set such that the length p of the patch image and the distances b1 and b2 did not satisfy the expression (1). Specifically, the speed ratio θ1 between the secondary transfer belt and the upstream brush and the speed ratio θ2 between the secondary transfer belt and the downstream brush were set at the same value, whereby the distances b1 and b2 were set to the same value. That is, the moving speed Va of the secondary transfer belt: the moving speed Vb1 of the upstream brush and the moving speed Vb2 of the upstream brush was set to be 1:1 (θ1=θ2=1). As a result, the distances b1 and b2 were both 57 mm, and the difference Δb between the distance b1 and the distance b2 was zero. The length p of the patch image and any other conditions of the MFP except for the foregoing were set at the same values as in Example 1.

A standard image output evaluation was made using paper output from this MFP. Stain on the back surface of paper due to poor cleaning of patch toner was at a non-permissible level that was recognizable even without a close look. The poor cleaning toner adhering to the secondary transfer belt was stripped off using a book tape and affixed to paper for optical measurement. As a result, the color difference ΔE between the portion where poor cleaning toner in black adhered most and the portion where no toner adhered was about 3.

Example 2

The MFP in Example 2 according to the present invention was set such that the length p of the patch image and the distances b1 and b2 further satisfied the expression (2) by reducing the length p of the patch image when compared with Example 1. Specifically, the maximum value of the length p of the patch image was set to 50 mm. The speed ratio θ1 between the secondary transfer belt and the upstream brush was set such that the moving speed Va of the secondary transfer belt: the moving speed Vb1 of the upstream brush=1:1 (θ1=1). The speed ratio θ2 between the secondary transfer belt and the downstream brush was set such that the moving speed Va of the secondary transfer belt: the moving speed Vb2 of the downstream brush=1:0.5 (θ2=0.5). As a result, the distance b1 was 57 mm, the distance b2 was 113 mm, and the difference Δb between the distance b1 and the distance b2 was 57 mm. The length p of the patch image was set to 50 mm. Except for the foregoing, the conditions of the MFP were set to the same values as in Example 1.

A standard image output evaluation was made using paper output from this MFP. Stain on the back surface of paper due to poor cleaning of patch toner was hardly recognized as image noise even with a close look. The poor cleaning toner adhering to the secondary transfer belt was stripped off using a book tape and affixed to paper for optical measurement. As a result, the color difference AE between the portion where poor cleaning toner in black adhered most and the portion where no toner adhered was 0.5.

Example 3

The MFP in Example 3 according to the present invention was set such that the length p of the patch image and the distances b1 and b2 further satisfied the expression (4) by reducing the length p of the patch image when compared with Example 2. Specifically, the maximum value of the length p of the patch image was set to 25 mm. Except for the foregoing, the conditions of the MFP were set to the same values as in Example 1.

A standard image output evaluation was made using paper output from this MFP. Stain on the back surface of paper due to poor cleaning of patch toner was hardly recognized as image noise even with a close look. The poor cleaning toner adhering to the secondary transfer belt was stripped off using a book tape and affixed to paper for optical measurement. As a result, the color difference ΔE between the portion where poor cleaning toner in black adhered most and the portion where no toner adhered was 0.5.

Example 4

The MFP in Example 4 according to the present invention had an upstream brush and a downstream brush having outer diameters different from each other and was set such that the length p of the patch image and the distances b1 and b2 satisfied the expression (1). Specifically, the upstream brush having an outer diameter of 36 mm and the downstream brush having an outer diameter of 12 mm were used. The speed ratio θ1 between the secondary transfer belt and the upstream brush and the speed ratio θ2 between the secondary transfer belt and the downstream brush were set at the same value. The moving speed Va of the secondary transfer belt: the moving speed Vb1 of the upstream brush and the moving speed Vb2 of the downstream brush was set to be 1:1 (θ1=θ2=1). As a result, the distance b1 was 113 mm, the distance b2 was 38 mm, and the difference Δb between the distance b1 and the distance b2 was 75 mm. Except for the foregoing, the conditions of the MFP were set at the same values as in Example 1.

A standard image output evaluation was made using paper output from this MFP. Stain on the back surface of paper due to poor cleaning of patch toner was at a permissible level although it was recognizable as image noise with a close look. The poor cleaning toner adhering to the secondary transfer belt was stripped off using a book tape and affixed to paper for optical measurement. As a result, the color difference ΔE between the portion where poor cleaning toner in black adhered most and the portion where no toner adhered was about 0.7.

The set conditions, specific set values, and evaluation results in Examples 1 to 4 of the present invention and Comparative Example 1 are shown in FIG. 17.

[Effects Of Embodiment]

The present embodiment provides an image forming apparatus capable of suppressing image noise.

According to the present embodiment, when patch toner of a patch image is removed by a cleaning device, poor cleaning toner discharged onto the transfer belt adheres onto the transfer belt in a distributed manner, so that the maximum amount of adherence of poor cleaning toner per unit area on the transfer belt can be reduced. As a result, poor cleaning toner is less likely to adhere locally on a part of paper, thereby suppressing image noise.

[Others]

The present invention can be applied to any cleaning device that removes patch toner on an image carrier and is applicable irrespective of the kind of image carrier (for example, photoconductor drum, intermediate transfer belt, or secondary transfer belt) and the material (for example, brush or foam) of a rotator in contact with the image carrier. More specifically, the cleaning device of the present invention may be cleaning device 15 or cleaning device 34 other than cleaning device 23. The cleaning device may include three or more rotators. When the cleaning device includes three or more rotators, the present invention is applicable if any two of them satisfy the relationship as described above.

The foregoing embodiments can be combined as appropriate. For example, the first modification and the second modification may be combined, or the first modification or the second modification may be combined for cleaning device 15 or cleaning device 34.

The processes in the foregoing embodiments may be performed by software or using hardware circuitry. A program executing the processes in the foregoing embodiments may be provided, or a recording medium such as a CD-ROM, a flexible disk, a hard disk, a ROM, a RAM, or a memory card encoded with the program may be provided to users. The program is executed by a computer such as a CPU. The program may be downloaded to the apparatus through a communication line such as the Internet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

an image carrier that rotates;

a patch image forming unit for forming a patch image of toner on the image carrier;

a first rotator coming into contact with the image carrier in a rotating state to remove the patch image from on the image carrier; and a second rotator arranged downstream from the first rotator along a rotational direction of the image carrier and coming into contact with the image carrier in a rotating state to remove the patch image from on the image carrier, wherein a length p of the patch image fanned by the patch image forming unit along the rotational direction of the image carrier, a distance b1 over which the image carrier rotates while the first rotator makes one turn, and a distance b2 over which the image carrier rotates while the second rotator makes one turn satisfy the following expression (1):

$$p \leq |b1-b2| \quad (1).$$

2. The image forming apparatus according to claim 1, further comprising:

a setting accepting unit for accepting a setting of the length p of the patch image; and a distance adjustment unit for adjusting at least one of the distances b1 and b2 based on the setting of the length p of the patch image accepted by the setting accepting unit.

3. The image forming apparatus according to claim 1, wherein the length p of the patch image and the distances b1 and b2 further satisfy the following expressions (2) and (3):

$$p \leq b1 \quad (2)$$

$$p \leq b2 \quad (3).$$

4. The image forming apparatus according to claim 3, wherein the length p of the patch image and the distances b1 and b2 further satisfy the following expressions (4) and (5):

$$p \leq (b1)/2 \quad (4)$$

$$p \leq (b2)/2 \quad (5).$$

5. The image forming apparatus according to claim 1, wherein the distances b1 and b2 further satisfy the following expressions (6) and (7):

$$b1 \neq n \times (b2) \quad (6)$$

$$b2 \neq n \times (b1) \quad (7)$$

where n is any natural number.

6. The image forming apparatus according to claim 1, wherein a diameter of the first rotator and a diameter of the second rotator are different from each other.

7. The image forming apparatus according to claim 1, further comprising an adjustment unit for adjusting at least one of the length p of the patch image, a moving speed of the first rotator, and a moving speed of the second rotator, depending on a purpose of forming a patch image, such that the length p of the patch image, the distance b1, and the distance b2 satisfy the expression (1) above.

8. A method of controlling an image forming apparatus including an image carrier that rotates, a patch image forming unit for forming a patch image of toner on the image carrier, a first rotator coming into contact with the image carrier in a rotating state to remove the patch image from on the image carrier, and a second rotator arranged downstream from the first rotator along a rotational direction of the image carrier and coming into contact with the image carrier in a rotating state to remove the patch image from on the image carrier, the method comprising:

accepting a setting of a length p of the patch image formed by the patch image forming unit along the rotational direction of the image carrier; and adjusting at least one of a distance b1 over which the image carrier rotates while the first rotator makes one turn and a distance b2 over which the image carrier rotates while the second rotator makes one turn, based on the accepted setting of the length p of the patch image, such that the distances b1 and b2 satisfy the following expression (1):

$$p \leq |b1 - b2| \quad (1).$$

9. A non-transitory computer-readable recording medium encoded with a control program for an image forming apparatus, the image forming apparatus including an image carrier that rotates, a patch image forming unit for forming a patch image of toner on the image carrier, a first rotator coming into contact with the image carrier in a rotating state to remove the patch image from on the image carrier, and a second rotator arranged downstream from the first rotator along a rotational direction of the image carrier and coming into contact with the image carrier in a rotating state to remove the patch image from on the image carrier, the control program causing a computer to execute:

accepting a setting of a length p of the patch image formed by the patch image forming unit along the rotational direction of the image carrier; and adjusting at least one of a distance b1 over which the image carrier rotates while the first rotator makes one turn and a distance b2 over which the image carrier rotates while the second rotator makes one turn, based on the accepted setting of the length p of the patch image, such that the distances b1 and b2 satisfy the following expression (1):

$$p \leq |b1 - b2| \quad (1).$$

* * * * *